United States Patent [19]

Jenison

[11] Patent Number: 4,695,051

[45] Date of Patent: Sep. 22, 1987

[54] COLLAPSIBLE DUMBBELLS

[76] Inventor: Robert E. Jenison, Rte. 1, Box 2149, Lopez, Wash. 98261

[21] Appl. No.: 751,751

[22] Filed: Jul. 3, 1985

Related U.S. Application Data

[63] Continuation-in-part of Ser. No. 639,265, Aug. 9, 1984, abandoned.

[51] Int. Cl.[4] ..... A63B 11/00

[52] U.S. Cl. ..... 272/122; 272/117

[58] Field of Search ..... 272/68, 119, 122, 123, 272/117; D21/196, 197; 128/402, 403

[56] References Cited

U.S. PATENT DOCUMENTS

| | | | |
|---|---|---|---|
| 259,752 | 6/1882 | Fisher | 272/122 |
| 812,144 | 2/1906 | Mackenzie et al. | 272/122 X |
| 3,231,270 | 1/1966 | Winer | D21/197 X |
| 3,334,899 | 8/1967 | Bosko et al. | 272/122 |
| 3,482,834 | 12/1969 | James, Jr. | 272/122 |
| 3,658,326 | 4/1972 | Fawick | 272/68 |
| 3,781,007 | 12/1973 | Baker et al. | 272/84 |
| 4,029,312 | 6/1977 | Wright | 272/122 X |
| 4,079,932 | 3/1978 | Schuetz | 272/75 |
| 4,103,887 | 8/1978 | Shoofler | 272/123 |
| 4,538,806 | 9/1985 | Wilkerson | 272/122 |

FOREIGN PATENT DOCUMENTS

| | | | |
|---|---|---|---|
| 729049 | 3/1966 | Canada | 272/122 |

*Primary Examiner*—Richard J. Apley
*Assistant Examiner*—Robert Bahr

[57] ABSTRACT

An elongated bladder has a hollow handle portion with an internal passage communicating with enlarged hollow end portions at opposite ends of said handle, respectively. One of the enlarged end portions has an inlet-outlet opening normally closed by a cap which is removable for filling the bladder with liquid to form a dumbbell. After exercise, the bladder can be drained for compact shipment or storage.

5 Claims, 9 Drawing Figures

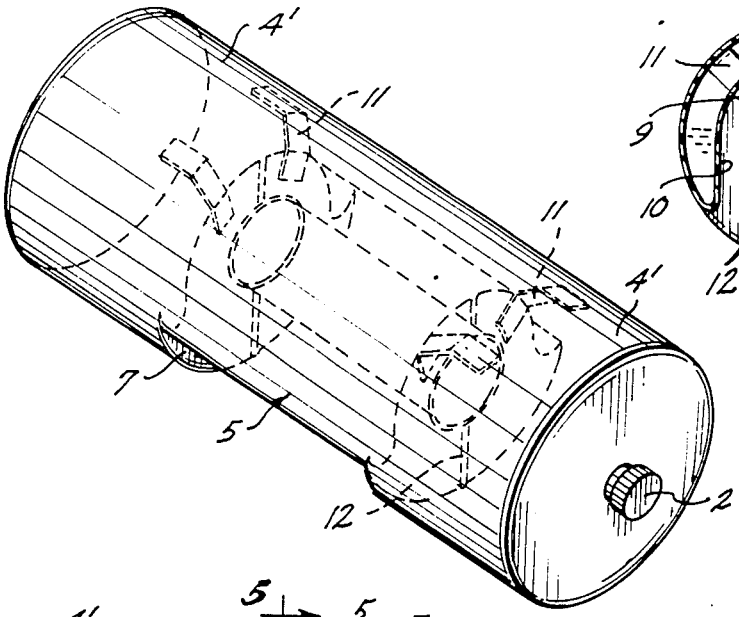
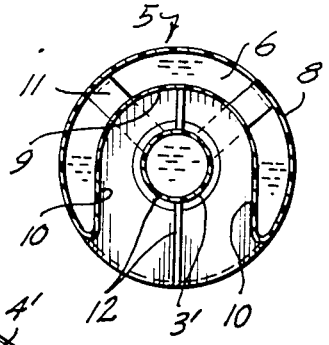
Fig. 5.
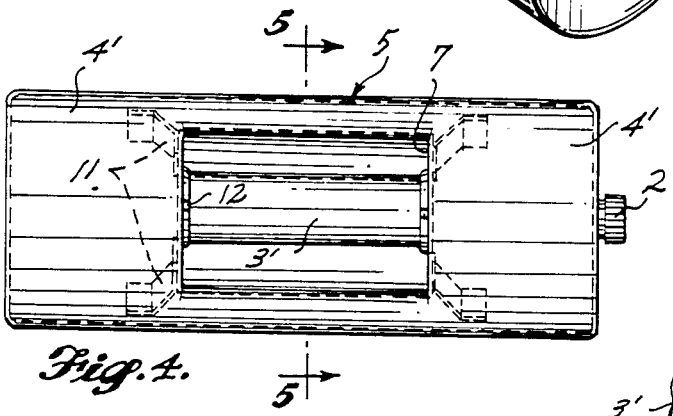
Fig. 4.
Fig. 7.
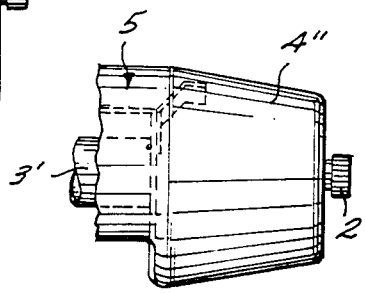
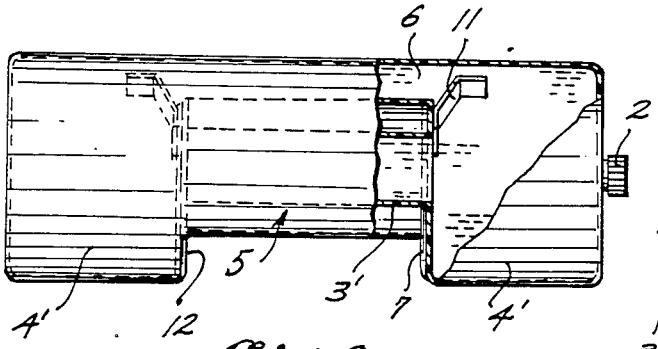
Fig. 6.
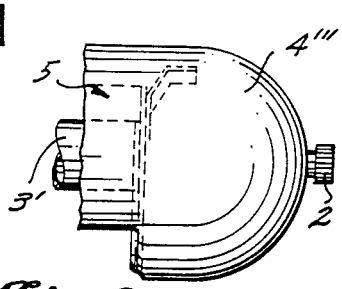
Fig. 8.

COLLAPSIBLE DUMBBELLS

CROSS REFERENCE

This application is a continuation-in-part of my copending application Ser. No. 639,265, filed on Aug. 9, 1984, now abandoned, for Collapsible Exercise Handweight.

BACKGROUND OF THE INVENTION

1. Field of the Invention

The present invention relates to an exercise device, more specifically a hand held exercising device, and still more specifically a hand held exercising device in the form of a flexible bladder distensible by filling with liquid to a predetermined shape appropriate for use during exercising.

2. Prior Art

Baker et al. U.S. Pat. No. 3,781,007, issued Dec. 25, 1973, discloses a Sectional, Folding, Combination Dumbell-Bar Bell having a multisection rigid handle bar. Flexible containers fillable with liquid are mounted on the opposite ends of the bar for swinging about the axis of the bar. Similarly, Shoofler U.S. Pat. No. 4,103,887, issued Aug. 1, 1978, discloses a Barbell With Collapsible Load Carrying Chambers including an elongated rigid bar with containers fillable with liquid or heavy particulate material pivotally mounted on the opposite end portions of the bar.

Schuetz U.S. Pat. No. 4,079,932, issued March 21, 1978, discloses Athletic Conditioning Apparatus including two rigid handweights connectable to the opposite end portions of a jump rope and fillable with water.

SUMMARY OF THE INVENTION

The principal object of the present invention is to provide an exercise device of the dumbbell type in a form easy and inexpensive to manufacture and convenient to use.

It also is an object to provide such a device sufficiently heavy for vigorous exercise but quickly and easily reducible in both weight and size for convenient shipment and storage, and requiring only water for quick conversion back from its light compact condition to its heavy exercise condition.

Another object is to provide such a device in which, in its heavy exercise condition, the weight is concentrated around the user's hand and balanced with respect to the hand for more comfortable use.

In the preferred embodiments of the present invention, the foregoing objects are accomplished by providing a collapsible dumbbell in the form of a bladder of flexible material distensible by introduction of liquid, preferably water, to assume a heavy exercise condition with the center of gravity located centrally of a handle portion of the dumbbell that can be grasped by the user. Such handle portion preferably is hollow and joins enlarged portions or chambers of the bladder at opposite ends of the handle. The bladder end portion chambers can be spherical or cylindrical but preferably are frustoconical or hemispherical so as to concentrate the weight of the dumbbell close to the handle. A central horseshoe or C section of the bladder can encircle 180 degrees or more of the handle and have an internal passage in communication with the bladder end portion chambers, sufficient room being provided for insertion of the user's hand into the opening of the horseshoe or C to grasp the handle, in which case even more weight of the dumbbell is concentrated close to the user's hand.

BRIEF DESCRIPTION OF THE DRAWINGS

FIG. 3 is a top perspective of a second embodiment of a collapsible dumbbell in accordance with the present invention; FIG. 4 is a bottom plan of the dumbbell of FIG. 3; FIG. 5 is a transverse section along line 5—5 of FIG. 4; and FIG. 6 is a side elevation of the dumbbell of FIG. 3 with parts broken away.

FIG. 7 is a fragmentary side elevation illustrating a first modification of the dumbbell of FIG. 3; and FIG. 8 is a corresponding fragmentary side elevation illustrating a second possible modification of the dumbbell of FIG. 3.

DETAILED DESCRIPTION

Figure 2:
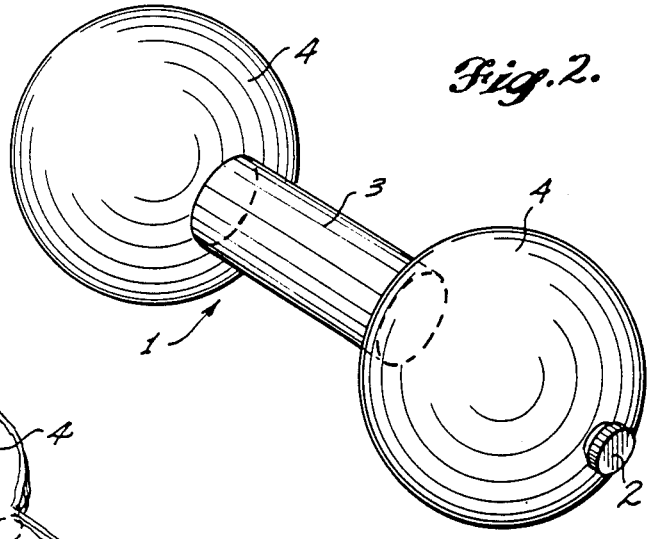
FIG. 2 is a top perspective of the dumbbell of FIG. 1 but in its distended or filled exercise condition.
Figure 1:
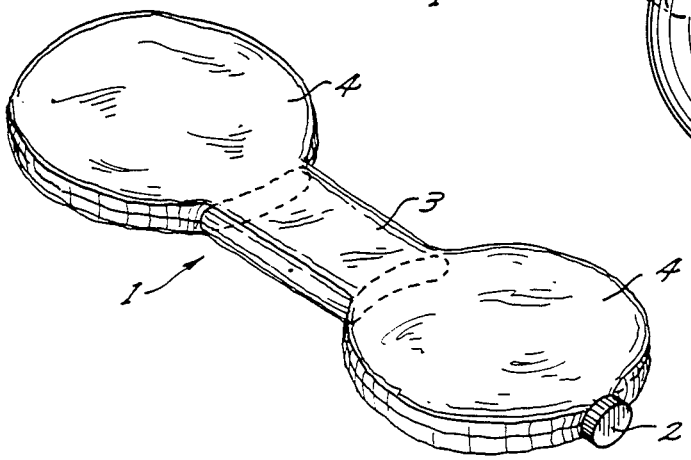
FIG. 1 is a top perspective of a collapsible dumbbell in accordance with the present invention in its compact condition suitable for shipment or storage.

As shown in FIGS. 1 and 2, the collapsible dumbbell in accordance with the present invention is in the form of an elongated bladder 1 of flexible water-impervious material with an inlet-outlet opening at one end that can be closed by a manually removable cap or plug 2. The bladder has an elongated central handle portion 3 joining the enlarged opposite bladder end portions or chambers 4.

Although flexible, preferably the bladder is nonstretchable, so that when it is filled with liquid by means of its single inlet-outlet opening, it assumes a predetermined shape as shown in FIG. 2. In the form shown in FIGS. 1 and 2, the handle portion 3 is cylindrical and joins the larger spherical end portions 4.

The axis of the cylindrical handle portion 3 intersects the center of each end portion 4 and also the center of the inlet-outlet opening closed by the removable cap 2. The weight of the cap is negligible as compared to the weight of the resulting water-filled dumbbell and, consequently, the center of gravity of the dumbbell is located internally of the handle portion approximately midway between its ends. During manipulation of the dumbbell while exercising, there is little tendency of it to twist or turn relative to the user's hand grasping the handle portion, so that the bladder can be of one-piece construction with the hollow handle portion nonrotatively joined to the larger end portions or chambers 4.

For storage or shipment, the single end cap or plug 2 can be removed to empty the bladder which then collapses to the condition shown in FIG. 1. From such condition, the bladder can be folded into even a more compact condition.

In the form shown in FIGS. 1 and 2, the maximum internal volume of each of the spherical bladder end portions or chambers 4 is substantially greater than the maximum internal volume of the handle portion 3. The bulk of the weight of the filled dumbbell is carried a substantial distance outboard of the opposite ends of the handle, increasing the tendency of the handle to bend and requiring stronger, stiffer materials. For example, the handle itself can be reinforced by an additional section of strong but still flexible material or can be formed of a different stronger material than the material used for the bladder chambers 4. In the form shown in FIGS. 3 through 6, however, the weight of the dumbbell is concentrated closer to the handle, although the construction of the bladder 1' shown in FIGS. 3 through 5 is more complicated.

Bladder 1' shown in FIGS. 3 through 6 is substantially cylindrical and still includes a hollow cylindrical handle portion 3' nonrotatively joined to enlarged end portions or chambers 4' with only a single end opening closable by the cap or plug 2. As best seen in FIG. 5, bladder 1' includes a horseshoe or C section 5 encircling at least 180 degrees of the handle portion 3'and having an internal passage 6 communicating with both bladder end portions 4'. In transverse cross section the outer wall 8 of such horseshoe section 5 is circular and forms an arc of approximately 270 degrees and is aligned with the periphery of the enlarged cylindrical bladder chambers 4'. The central portion 9 of the inner wall of such horseshoe section 5 is circular and forms an arc of about 180 degrees approximately centered at the axis of the handle portion 3', the opposite end portions 10 of such inner wall extending linearly, tangentially from the circular inner wall portion 9 toward the bottom of the bladder where they meet the horseshoe section outer wall 8.

The spacing between the periphery of the handle portion 3' and the inner wall 9, 10 of the horseshoe bladder section is sufficient for insertion of the user's hand and fingers to grasp the handle portion.

The handle portion can be offset slightly toward the closed central portion of the horseshoe section, as compared to a line connecting the centers of gravity of the respective enlarged bladder chambers 4', so that the center of gravity of the filled dumbbell still is located internally of the handle portion 3' approximately midway between its ends.

For additional support of the handle portion, internal straps 11 are provided generally at opposite end portions of the handle. Each strap has one end portion joined to the interior side of the upright wall 7 surrounding the corresponding handle end and its other end portion joined to the inner periphery of the top of the bladder chamber 4' at the same end. In addition, the upright walls 7 at the opposite ends of the handle can have rounded strengthening ribs or beads 12 extending radially inward from the bottom of the bladder to and then circumferentially around the periphery of the handle ends, and then radially upward to the horseshoe section inner wall 9.

Prior to shipment or storage, the bladder 1' can be emptied by means of the single inlet opening normally closed by cap or plug 2 for converting the bladder to a collapsed, preferably foldable, compact and light condition.

Figure 9:
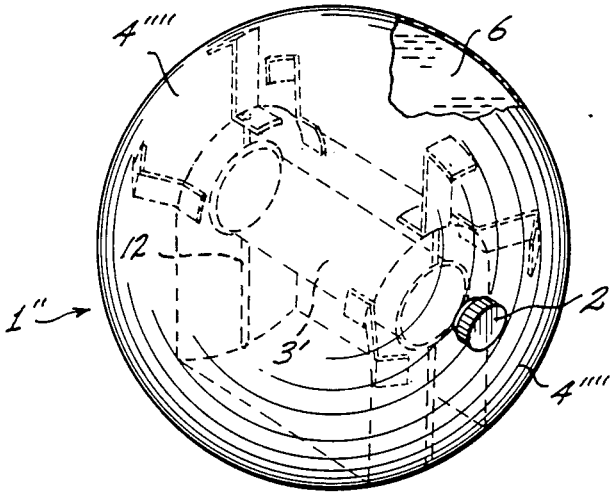
FIG. 9 is a top perspective of a third embodiment of a collapsible dumbbell in accordance with the present invention.

As noted above, substantially enclosing the user's hand with the horseshoe or C section 5 of the bladder tends to concentrate the weight of the dumbbell around the user's hand and also reduces the overall length of the bladder for a given liquid-filled weight. As shown in FIGS. 7, 8 and 9, for an even greater concentration of the weight closer to the user's hand, the bladder end portions or chambers can be tapered outward. In the form shown in FIG. 7, the end portions 4'' are generally frustoconical, whereas in the form shown in FIG. 8 the end portions 4''' are generally hemispherical. In the form shown in FIG. 9, the outer periphery of the entire bladder 1'' including the central horseshoe section 5' is substantially spherical for an even greater concentration of the weight closer to the cylindrical handle portion 3' extending between the enlarged end portions 4'''', a substantial portion of the weight being from liquid in the horseshoe passage 6' which decreases in cross-sectional area from the center of the bladder toward the end chambers. In other respects, the general construction of each of the forms shown in FIGS. 7, 8 and 9 is identical to the form shown in FIGS. 3 through 6.

I claim:

1. In combination, a hollow, flexible, collapsible, fillable hand held exercise device having two enlarged chambers at opposite ends of a centrally located axially balanced handle portion and a hollow, flexible, collapsible, fillable horseshoe cross section, elongated lengthwise of said handle portion, forming an internal passage communicating with both of said enlarged chambers and encircling at least 180 degrees of said handle portion leaving space for a hand between the inner wall of said horseshoe cross section and said handle portion.

2. A hand held exercising device comprising a handle portion, two enlarged, collapsible, fillable chamber portions of flexible material at opposite ends of said handle portion, respectively, an elongated, hollow, flexible, collapsible, fillable horseshoe cross section elongated lengthwise of said handle portion and having an inner wall encircling at least 180 degrees of the circumference of said handle portion and spaced outward therefrom, said portion of horeshoe cross section forming an internal passage communicating with the interiors of both of said chamber portions, there being support straps extending radially from opposite ends of said handle portion to points on the inside of the outer wall of said chamber portions.

3. The device claimed in claim 2, in which the portion of the horseshoe cross section has an outer wall meeting the outer peripheries of the chamber portions tangentially, and in which the outer periphery of such portion in combination with the outer peripheries of the chamber portions is generally spherical.

4. The device defined in claim 2, in which, when filled with liquid, the center of gravity of such device is located interiorly of the handle portion approximately midway between its ends.

5. A hand held exercising device comprising an elongated handle portion, two enlarged, collapsible, fillable chamber portions of flexible material at opposite ends of said handle portion, respectively, an elongated, hollow, flexible, collapsible, fillable horseshoe cross section elongated lengthwise of said handle portion and having an inner wall encircling at least 180 degrees of the circumference of said handle portion and spaced outward therefrom, said portion of horseshoe cross section forming an internal passage communicating with the interiors of both of said chamber portions, there being strengthening ribs starting at the opposite ends of a line, generally parallel to said handle portion dividing the inside wall of said horseshoe cross section in the middle, thence extending across the respective ends of said handle portion to the outside perimeter of said chamber portions.

* * * * *